US010323512B2

(12) United States Patent
Duchene et al.

(10) Patent No.: US 10,323,512 B2
(45) **Date of Patent: *Jun. 18, 2019**

(54) SYSTEM AND METHOD FOR DOWNHOLE INORGANIC SCALE MONITORING AND INTERVENTION IN A PRODUCTION WELL

(71) Applicants: Aurelie Duchene, Houston, TX (US); Alessandro De Barros, Rio de Janeiro (BR); Hartley Downs, Houston, TX (US); Eduardo Motta, Rio de Janeiro (BR); Potiani Maciel, Rio de Janeiro (BR); Ashwin Chandran, Spring, TX (US); Thomas Scott, Cypress, TX (US); Rocco DiFoggio, Houston, TX (US); Tudor Ionescu, Houston, TX (US); Eric Donzier, Houston, TX (US)

(72) Inventors: Aurelie Duchene, Houston, TX (US); Alessandro De Barros, Rio de Janeiro (BR); Hartley Downs, Houston, TX (US); Eduardo Motta, Rio de Janeiro (BR); Potiani Maciel, Rio de Janeiro (BR); Ashwin Chandran, Spring, TX (US); Thomas Scott, Cypress, TX (US); Rocco DiFoggio, Houston, TX (US); Tudor Ionescu, Houston, TX (US); Eric Donzier, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 533 days.

This patent is subject to a terminal disclaimer.

(21) Appl. No.: 14/807,287

(22) Filed: Jul. 23, 2015

(65) Prior Publication Data

US 2016/0024915 A1 Jan. 28, 2016

Related U.S. Application Data

(60) Provisional application No. 62/028,017, filed on Jul. 23, 2014.

(51) Int. Cl.
*E21B 49/08* (2006.01)
*E21B 37/06* (2006.01)
*E21B 47/06* (2012.01)

(52) U.S. Cl.
CPC ..... *E21B 49/088* (2013.01); *E21B 37/06* (2013.01); *E21B 47/06* (2013.01); *E21B 47/065* (2013.01);
(Continued)

(58) Field of Classification Search
CPC ..... E21B 37/06
See application file for complete search history.

(56) References Cited

U.S. PATENT DOCUMENTS 5,350,922 A 9/1994 Bartz
6,513,385 B1 2/2003 Han et al.
(Continued)

FOREIGN PATENT DOCUMENTS

WO 2001004460 A1 1/2001
WO 2001020322 A1 3/2001
(Continued)

OTHER PUBLICATIONS

Alderman, et al.; "Total System Approach for Upstream Chemicals"; Baker Hughes Incorporated; 2013; 293 pages.
(Continued)

*Primary Examiner* — David J Bagnell
*Assistant Examiner* — Jonathan Malikasim
(74) *Attorney, Agent, or Firm* — Cantor Colburn LLP

(57) ABSTRACT

An apparatus for estimating an ambient environment at which inorganic scale will form in a downhole fluid includes a stress chamber disposed in a borehole in a production zone at a location within a specified range of maximum pressure and configured to receive a sample of the fluid from the production zone and to apply an ambient condition to the
(Continued)

sample that causes the formation of inorganic scale. An inorganic scale sensor is configured to sense formation of inorganic scale within the chamber and an ambient environment sensor is configured to sense an ambient environment within the chamber at which the formation of inorganic scale occurs. The apparatus further includes a processor configured to receive measurement data from the inorganic scale sensor and the ambient environment sensor and to identify the ambient environment at which the formation of inorganic scale occurs.

18 Claims, 7 Drawing Sheets

(52) U.S. Cl.
CPC ..... *E21B 49/081* (2013.01); *E21B 2049/085* (2013.01)

(56) References Cited

U.S. PATENT DOCUMENTS

| | | | | |
|---|---|---|---|---|
| 6,880,402 | B1 | 4/2005 | Couet et al. | |
| 6,886,406 | B1 | 5/2005 | Couet et al. | |
| 8,408,314 | B2 * | 4/2013 | Patel | E21B 37/06 166/306 |
| 8,528,396 | B2 | 9/2013 | Wu et al. | |
| 2001/0054514 | A1 | 12/2001 | Sullivan et al. | |
| 2004/0104341 | A1 | 6/2004 | Betancourt et al. | |
| 2007/0238180 | A1 | 10/2007 | DiFoggio et al. | |
| 2011/0249266 | A1 | 10/2011 | Kumar | |
| 2013/0239664 | A1 * | 9/2013 | Hsu | E21B 47/102 73/54.02 |
| 2014/0024073 | A1 | 1/2014 | Zhdaneev et al. | |
| 2016/0024916 | A1 | 1/2016 | De Oliveira et al. | |

FOREIGN PATENT DOCUMENTS

| | | | |
|---|---|---|---|
| WO | 2013106736 | A1 | 7/2013 |
| WO | 2013190093 | A2 | 12/2013 |

OTHER PUBLICATIONS

Almutairi, et al.; "Detection of Scale Deposition Using Distributed Temperatufe Sensing"; SPE113595; 2008, Society of Petroleum Engineers; 13 pages.

Amari, et al.; "Acoustic Properties of Aqueous Suspensions of Clay and Calcium Carbonate"; Journal of Colloid and Interface Science, vol. 134, No. 2, Feb. 1990; 10 pages.

Belhaj, et al.; "Asphaltene Stability in Crude Oil during Production Process"; Petroleum & Environmental Biotechnology vol. 4 (3), 1000142; 5 pages.

Boerkamp, et al.; "Determining Crystal Growth Kinetic Parameters Using Optical Fibre Sensors"; Journal of Crystal Growth; 2012, Elsevier; 3 pages.

Castillo, et al.; "Optical fiber extrinsic refractometer to measure RI of samples in a high pressure and temperature systems: Application to wax and asphaltene precipitation measurements" ; Fuel; 85; (2006); 9 pages.

Cloutis, Edward A.; "Spectral Reflectance Properties of Hydrocarbons: Remote-Sensing Implications"; Science vol. 245; 1989; 4 pages.

Dudasova, et al.; "Quartz Crystal Microbalance Monitoring of Asphaltene Adsorption/Deposition"; Journal of Dispersion Science and Technology vol. 29; 2008; 9 pages.

Hull, et al.; "Well Integrity Monitoring & Analysis Using Distributed Acoustic Fiber Optic Sensors"; IAD/SPE 128304; 2010; IADC/SPE Drilling Conference and Exhibition; New Orleans Louisiana; 7 pages.

Kokal, et al.; "Asphaltenes: the Colesterol of Petroleum"; SPE 29787; 1995; Society of Petroleum Engineers, Inc.; 13 pages.

Nasser et al.; "Incline Monitoring the Effect of Chemical Inhibitor on the Calcium Carbonate Precipitation and Agglomeration"; chemical engineering research and design 8 9 ( 2 0 1 1 ) 500-511; 12 pages.

Notification of Transmittal of the International Search Report and the Written Opinion of the International Searching Authority, or the Declaration; PCT/US2015/041730; dated Oct. 27, 2015; 13 pages.

Notification of Transmittal of the International Search Report and the Written Opinion of the International Searching Authority, or the Declaration; PCT/US2015/041733; dated Mar. 16, 2016; 14 pages.

Poyet, et al.; "Real-Time Method for the Detection and Characterization of Scale"; SPE 74659; 2002, Society of Petroleum Engineers Inc.; 11 pages.

Ramadan, et al.; "In Situ Monitoring of Deposition and Dissolution of Calcium Carbonate by Acoustic Emission Techniques Associated to Electrochemical Measurements";Desalination 219 (2008) 358-366; 9 pages.

Saurina, et al.; "Determination of Calcium and Total Hardness in Natural Waters Using a Potentiometric Sensor Array"; Analytica Chimica Acta 464 (2002) 89-98; Elsevier; 10 pages.

Souza, et al.; "The Precipitation Onset of Asphaltenes in Solvents of Different Solubility Parameter"; Progress in Colloid & Polymer Science v. 128; 2004; 5 pages.

Zougagh et al.; "Direct Determination of Total Carbonate Salts in Soil Samples by Continuous-Flow Piezoelectric Detection"; Talanta 65 (2005) 29-35; 7 pages.

* cited by examiner

SYSTEM AND METHOD FOR DOWNHOLE INORGANIC SCALE MONITORING AND INTERVENTION IN A PRODUCTION WELL

CROSS REFERENCE TO RELATED APPLICATIONS

This application claims the benefit of an earlier filing date from U.S. Provisional Application Ser. No. 62/028,017 filed Jul. 23, 2014, the entire disclosure of which is incorporated herein by reference.

BACKGROUND

Wells are drilled in subsurface formations for the production of hydrocarbons (oil and gas). After drilling, the wellbore is completed typically by lining the wellbore with a casing that is perforated proximate to each oil and gas bearing formation (also referred to herein as the "production zone" or "reservoir") to extract the fluid from such reservoirs (referred to as "formation fluid"), which typically includes water, oil and/or gas. In multiple production zone wells, sometimes the well is completed with system of packers, monitoring instrumentation, chemical injection valves, inflow control valves and surface control facilities (referred to as "intelligent well" or "intelligent completion"). Intelligent wells are especially useful for areas where intervention costs are high, since they allow operators to remotely monitor and change well conditions without the use of an intervention rig, reducing the total cost of ownership and optimizing production.

Inorganic scale, such as calcium carbonate, results from the precipitation of minerals from water which may be naturally occurring reservoir water or water deriving from water floods. The potential for inorganic scale increases with increased water production. A majority of the wells typically produce hydrocarbons and a certain amount of water that is naturally present in the reservoir. However, under various conditions, such as when the reservoir has been depleted to a sufficient extent, substantial amounts of water present is adjacent formations can penetrate into the reservoir and migrate into the well, or due to other reasons such as the presence of faults in the formation containing the reservoir, particularly in high porosity and high mobility formations. Faults in cement bonds between the casing and formation, holes developed in the casing due to corrosion, etc. may also be the source of water entering the well.

Scale deposition is effected mainly, but not only, by any changes in pressure, temperature, and flow velocity. Scale formation can occur in the reservoir, in the completion, in production lines, and in surface equipment. Common types of inorganic scale comprise: carbonate scales (calcium, magnesium, iron); sulfate scales (calcium, barium and strontium, magnesium); sulfide scales (iron and zinc); iron scales (oxides, carbonates, sulfides); silica scales; and salt scales (calcium, potassium, sodium).

In some areas, produced water presents self-scaling tendency when it flows into the wellbore. In the wellbore, equilibrium conditions that keep inorganic scale from forming or precipitating may change due to changes in pressure and/or temperature. That is, the equilibrium conditions may shift to favor solid-phase formation or precipitation. Unfortunately, the formation or precipitation of inorganic scale can be detrimental to production equipment either downhole or at the surface due to the scale plugging pipes or tubing carrying produced formation fluid. Hence, apparatus and method that can anticipate and diagnose production problems caused by inorganic scales, can predict where inorganic scale may be formed or precipitated in production equipment, can assess the relative effectiveness of various preventative methods (e.g., the efficacy of different inorganic scale inhibitors) under downhole conditions, can provide sufficient warning to develop contingency plans and stage remediation programs, and can prevent its formation would be well received in the oil industry.

BRIEF SUMMARY

Disclosed is an apparatus for estimating an ambient environment at which inorganic scale will form in a downhole fluid. The apparatus includes: a stress chamber disposed in a borehole in a production zone at a location within a specified range of maximum pressure and configured to receive a sample of the fluid from the production zone and to apply an ambient condition to the sample that causes the formation of inorganic scale; an inorganic scale sensor configured to sense formation of inorganic scale within the chamber; an ambient environment sensor configured to sense an ambient environment within the chamber at which the formation of inorganic scale occurs; and a processor configured to receive measurement data from the inorganic scale sensor and the ambient environment sensor and to identify the ambient environment at which the formation of inorganic scale occurs.

Also disclosed is an apparatus configured for preventing formation of inorganic scale in a fluid produced from a production zone in a plurality of production zones of a borehole penetrating the earth. The apparatus includes: an intelligent completion (IC) pack disposed in each production zone; a chemical injection system disposed at a surface of the earth and configured to inject a chemical into a selected production zone using a chemical injection line and a selected chemical injection mandrel; an IC control module configured to control each of the IC packs; and a supervisory system configured to obtain measurement data from each downhole sensor, determine a margin to formation of inorganic scale in each production zone using the measurement data, and send commands to the chemical injection system and the IC control module to prevent the formation of inorganic scale. Each IC pack includes an electronic chemical injection mandrel, an electric inflow control valve, a downhole pressure and temperature sensor, a stress chamber, and an electric line configured to supply electric power and/or communications to components of the IC pack, an intelligent completion (IC) pack disposed in each production zone, each IC pack comprising an electronic chemical injection mandrel, an electric inflow control valve, a downhole pressure and temperature sensor, a stress chamber, and an electric line configured to supply electric power and/or communications to components of the IC pack, wherein the stress chamber is configured to receive a sample of the fluid from a production zone in which the stress chamber is disposed at a location within a specified range of maximum pressure and to apply an ambient condition to the sample that causes the formation of inorganic scale, and the stress chamber comprises a piston configured to move within the chamber, a motor mechanically coupled to the piston and configured to move the piston, an inorganic scale sensor configured to sense formation of inorganic scale within the chamber, and an ambient environment sensor configured to sense an ambient environment within the chamber at which the formation of inorganic scale occurs, and the stress chamber comprises a piston configured to move within the chamber, a motor mechanically coupled to the piston and configured to move the piston, an inorganic scale sensor configured to sense formation of inorganic scale within the chamber, and an ambient environment sensor configured to sense an ambient environment within the chamber at which the formation of inorganic scale occurs.

Further disclosed is a method for estimating a margin to formation of inorganic scale in a fluid produced from a production zone of a borehole penetrating the earth. The method includes: producing a formation fluid in the production zone; collecting a sample of the formation fluid in the production zone and disposing the sample in a stress chamber disposed in the production zone; preconditioning the sample by separating phases of the sample; applying an ambient condition to the sample that causes the formation of inorganic scale using the stress chamber; and estimating the margin for a location in a production path from the production zone to a surface of the earth by calculating a difference between an ambient environmental condition at the location and the ambient condition that causes the formation of inorganic scale in the stress chamber using a processor.

Further disclosed is a non-transitory computer-readable medium comprising instructions for calculating where inorganic scale formation would form in a production fluid in a product path from downhole to a surface of the earth which when executed by a computer implement a method that includes: receiving an ambient condition at which organic scale forms in a sample of the production fluid in a stress chamber disposed in a production zone at a location within a specified range of maximum pressure, the stress chamber being configured to apply the ambient condition to the sample; calculating a difference between the ambient condition applied by the stress chamber and an ambient environmental condition at points along the production path; and identifying those points along the production path where the difference is less than a selected setpoint.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Disclosed are apparatus and method for estimating where in a chain of well-production components inorganic scale may occur due to changes in ambient conditions to which extracted formation fluids are exposed as the fluid flows through the chain. Once the potential locations for scale formation are estimated, then actions may be taken to prevent the scale formation. Non-limiting embodiments of such actions include chemical injection and maintaining the production fluid above a certain pressure and/or temperature as determined by downhole testing.

Figure 1:
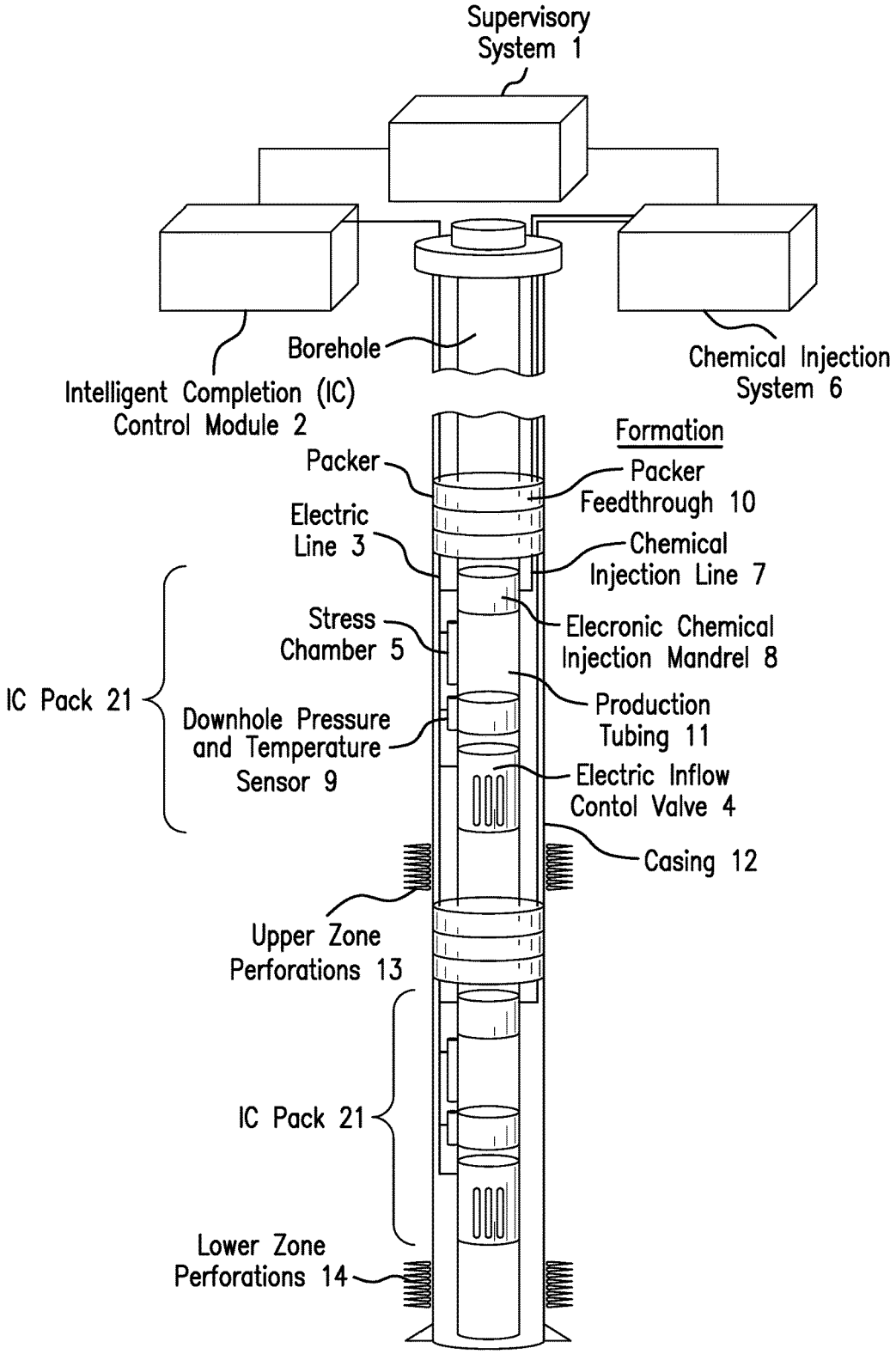
FIG. 1 illustrates a cross-sectional view of a production well with intelligent completion penetrating an earth formation.

FIG. 1 illustrates a cross-sectional view of an exemplary embodiment of a well 20 having two production zones with an all-electric intelligent completion (IC) pack 21 installed in each zone. While the all-electric IC pack 21 is illustrated and discussed for teaching purposes, other types of IC packs may be used such as those using hydraulic or pneumatic power or some combination thereof or some combination in concert with electric power. In addition, optical communication may be incorporated using optical fiber as a communication medium. The schematic of FIG. 1 illustrates a surface equipment supervisory system 1, instrumentation and control module 2 and chemical injection system 6, which are disposed at the surface of the earth. Alternatively, any of these components or combination of components may be disposed downhole. FIG. 1 also illustrates downhole equipment, which may include an electric inflow control valve 4, a stress chamber 5, a downhole pressure and temperature gauge (or sensor) 9, a chemical injection mandrel 8, and a packer feedthrough 10. The chemical injection system 6 is configured to inject certain chemicals or inhibitors downhole in order to prevent the formation of inorganic scale. The chemicals are injected at a calculated rate through chemical injection valves located upstream of a point where phase change or precipitate is expected to occur. Production chemicals are injected where mixing conditions have been evaluated to reach full effectiveness. Special injection equipment like quills may be recommended. Sampling points for testing produced fluid samples are generally positioned downstream of the point where full mixing and adequate contact time has been allowed in order to enable an assessment of treatment effectiveness. In that these chemicals and associated flow rates are known in the art, they are not discussed in further detail.

The supervisory system 1 is configured to receive information from downhole sensors, analyze this information, and send commands to IC components through the IC control module 2. The IC Control Module 2 (also referred to as a controller) is configured to receive/send information to all IC components downhole and to control electric power supply to downhole systems and components. The electric line 3 is configured to supply energy to all Intelligent Completion System components in each producer/injector zone, including the inflow control valve 4, the stress chamber 5, the chemical injection mandrel 8, and the downhole pressure and temperature gauge 9. The electric inflow control valve 4 is configured to regulate the inflow from the formation to the production tubing 11 The stress chamber 5 is configured to separate the oil phase from water phase of a formation fluid sample by gravity separation or other preconditioning processes such as membrane separation. The chemical injection system 6 includes surface chemical injection system components, chemical injection lines 7, and the chemical injection mandrel 8. The chemical injection system 6 is controlled by the supervisory system 1. The chemical injection lines 7 are configured inject chemicals from the surface to downhole. The chemical injection mandrel 8 includes an electronic injection valve to provide efficient chemical treatment at each zone. The downhole pressure and temperature gauge 9 is configured to sense downhole pressure and temperature and send sensed pressure and temperature information to the supervisory system 1 at surface. In one or more embodiments, the downhole pressure and temperature gauge 9 is a permanent downhole gauge referred to as a PDG. Packer feedthrough 10 provides isolation between production tubing 11 and casing 12, allowing the control lines passage through it for connection with all IC system components installed in each zone (multiple zones) below the surface. The intelligent completion system components can be installed in multi-zones wells with two or more zones. For each producer/injector depth interval (identified by perforations 13 and 14), the intelligent completion pack 21 is installed and each pack includes the electronic inflow control valve 4, the stress chamber 5, the chemical injection mandrel 8, the downhole pressure and temperature gauge 9, the electric line 3, the chemical injection line 7, and the packer feedthrough 10.

Figure 2:
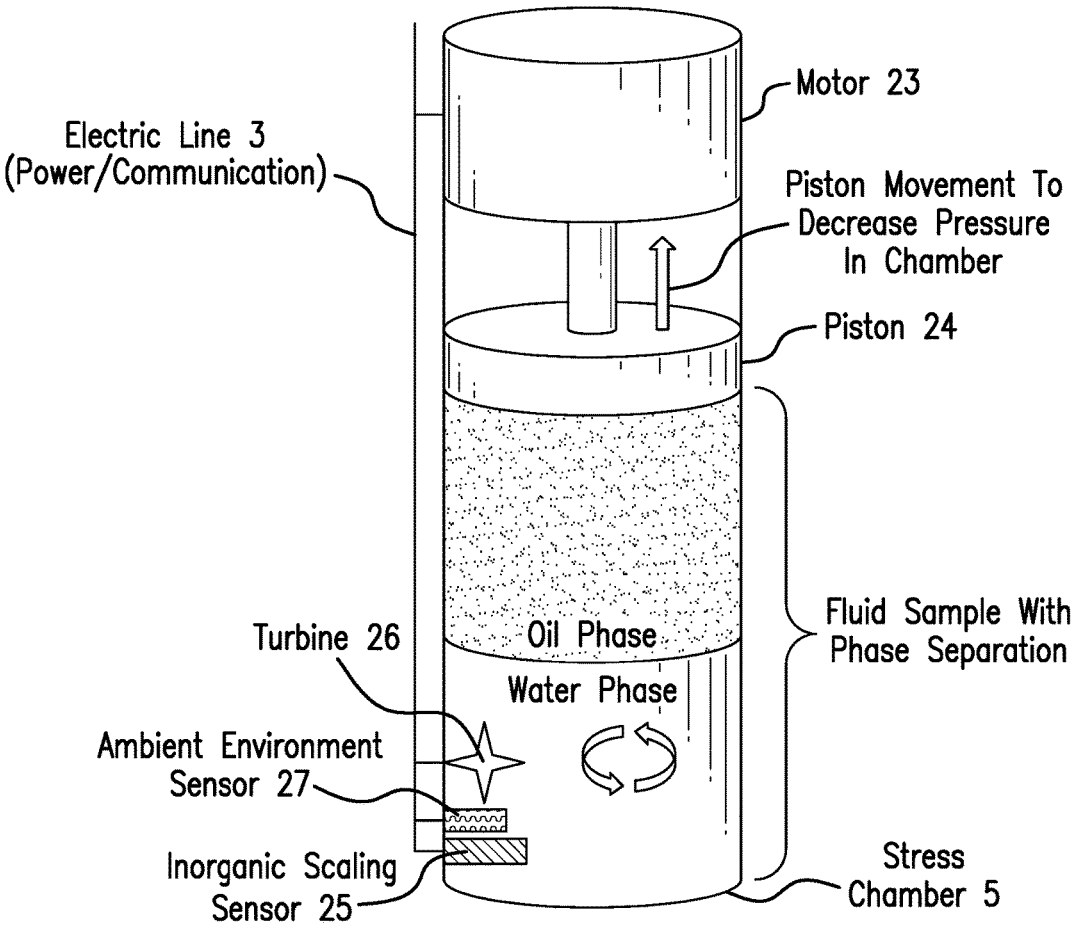
FIG. 2 depicts aspects of a stress chamber for changing an ambient condition of a fluid sample extracted from earth formation.

FIG. 2 is cross-sectional schematic view of the stress chamber 5. The stress chamber 5 includes a motor 23, a piston 24, an inorganic scale sensor 25, a turbine 26, an ambient environment sensor 27, and the electric line 3 to feed the internal system. The electric line 3 is configured to supply electrical energy for the stress chamber 5 and is also configured to transmit inorganic scaling sensor data from the sensor 25 to the supervisory system 1 at the surface. The stress chamber 5 is configured to separate the oil phase from water phase of a fluid sample obtained from the borehole by gravity segregation or any suitable mechanical method, allowing measurements to be obtained by the inorganic scale sensor 25. The motor 23 is configured to move the piston 24 to increase the volume in the chamber thereby decreasing the pressure inside the stress chamber 5 and inducing the formation of inorganic scale particles. Electric energy is fed to the motor 23 by the electric line 3. The piston 24 is used to increase the internal volume of the stress chamber 5, allowing the pressure to decrease and, thus, stressing the sample. It is moved by the motor 23 via a mechanical coupling. The inorganic scale sensor 25 is configured to detect the formation of scale in the water phase. The electric line 3 is configured to supply electric power to the sensor 25 and to also transmit sensor 25 data to the surface such as to the supervisory system 1. The turbine 26 may be electric powered and is configured to keep the water phase circulating and, thus, providing the dynamic conditions for the inorganic scale sensor 25 to perform measurements. In the embodiment of using optical sensors for the organic scale sensor 25, the turbine 26 is not needed. The ambient environment sensor 27 is configured to sense an ambient condition internal to the stress chamber 5 to which the fluid sample is exposed. Non-limiting embodiments of the ambient environment sensor 27 include a pressure sensor, a temperature sensor or both. Other types of sensors may also be used. Hence, the ambient conditions that lead to the formation of inorganic scale may be determined using measurements from the inorganic scale sensor 25 and the ambient environment sensor 27. In one or more embodiments, the supervisory system 1 will record the ambient environmental condition provided by the sensor 27 when the inorganic scale sensor 25 senses the formation of scale.

The inorganic scale sensor 25 may include different types of sensors. Each of the sensors provides an output that may be indicative of inorganic scale formation. The output of each sensor may be calibrated by analysis or testing of a sample containing inorganic scale. In one or more embodiments, the inorganic scale sensor may include at least one of a conductivity sensor, a resonance sensor, and an optical sensor. The conductivity sensor may include two electrodes that apply a known voltage to the sample and a current sensor to measure a resulting electrical current flowing between the two electrodes. The conductivity sensor then calculates or determines the conductivity of the sample from the voltage and the measured current. The conductivity of the sample as determined by the output of the conductivity sensor may be indicative of inorganic scale detection. In one or more embodiments, inorganic scale is detected when the measured conductivity falls into a detection criterion. The resonance sensor may be flexural mechanical resonator such as a piezoelectric tuning fork resonator that is configured to resonate in the sample and to measure a mechanical impedance of the sample. The measured mechanical impedance as determined by the output of the resonance sensor may be indicative of inorganic scale detection. In one or more embodiments, inorganic scale is detected when the measured mechanical impedance falls into a detection criterion. The optical sensor may include one or multiple light sources operating at a single or multiple wavelengths, such as an infrared light source, and one or multiple photodetectors that are configured to sense light that is either reflected by the sample or transmitted through the sample. The measurements by the photodetectors could be used separately or in conjunction to indicate the formation of organic scale within the chamber. The detection criterion for the inorganic scale sensor 25 may be determined by analysis or by laboratory testing such as by testing the sensor 25 using fluid with inorganic scale having known properties.

Figure 3:
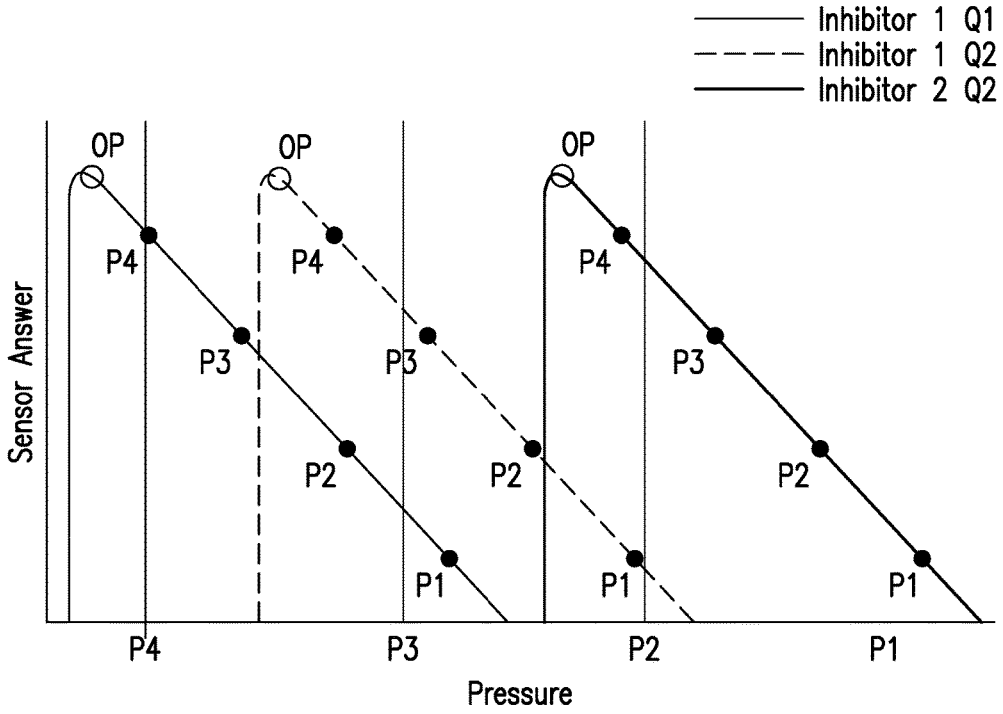
FIG. 3 presents a graph of sensor signal versus pressure of the sample for two inhibitors and two different dosages.

As discussed above, chemical inhibitors may be injected downhole to prevent the formation of inorganic scale. FIG. 3 presents a graph of the inorganic scale sensor signal versus pressure along a pressure profile during production as a function of the inorganic scale inhibitor (Inhibitor 1 or Inhibitor 2) and its dosage (Q1 or Q2). Points P1, P2, P3, and P4 represent pressures at locations corresponding to reservoir pressure, tubing inlet pressure, wellhead pressure, and surface facility pressure, respectively. For each inorganic scale inhibitor and its dosage, the pressure at which asphaltenes begin to precipitate is indicated as the Onset Pressure (OP) point. The most effective inhibitor and dosage will provide an OP that is lower than the lowest pressure encountered in surface facilities (P4); this is the case for Inhibitor 1 when used at a high dosage rate of Q1. In this example, when Inhibitor 1 is used at a low dosage rate of Q2, then the organic scale will begin to form in the flowline at a pressure that is intermediate between the wellhead pressure (P3) and the surface pressure (P4). A different inhibitor (I2) may have an OP that occurs at a pressure intermediate between the tubing inlet pressure (P2) and the wellhead pressure (P3) indicating that if inhibitor I2 is used at a dosage of Q2, then organic scale will precipitate in the tubing. The system answer provided by the supervisory system 1 will anticipate where the inorganic scale will occur, thus, providing the information to decide the best strategy to prevent it. It can be appreciated that a change in slope of the inorganic scale sensor response curve as pressure decreases and inorganic scale precipitates allows for determining whether precipitation occurs upstream of the stress chamber (i.e., in the formation). This is an advantage of this type of sensor when used for detecting precipitation of inorganic scale.

Figure 4:
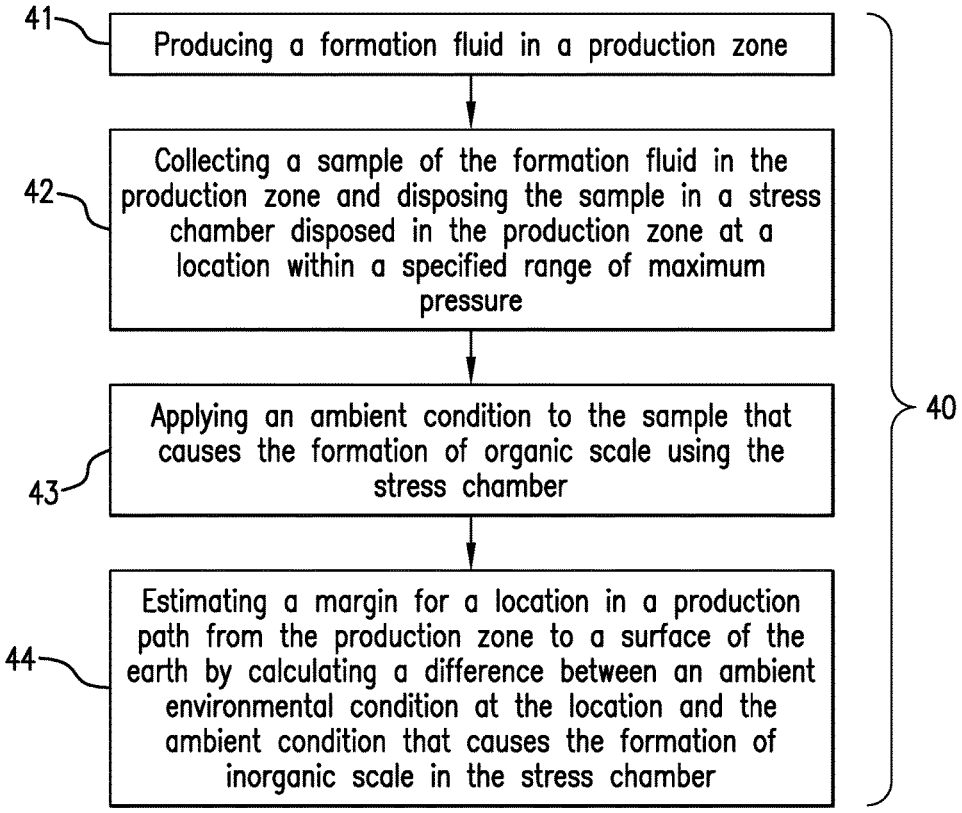
FIG. 4 is a flow chart for a method estimating an ambient condition at which inorganic scale will form in a downhole fluid

FIG. 4 is a flow chart for a method 40 for estimating a margin to formation of inorganic scale in a fluid produced from a production zone of a borehole penetrating the earth. Block 41 calls for producing a formation fluid in the production zone. Block 42 calls for collecting a sample of the formation fluid in the production zone and disposing the sample in a stress chamber disposed in the production zone. Block 43 calls for applying an ambient condition (i.e., ambient environmental condition) to the sample that causes the formation of inorganic scale using the stress chamber. Block 44 calls for estimating the margin for a location in a production path from the production zone to a surface of the earth by calculating a difference between an ambient environmental condition at the location and the ambient condition that causes the formation of inorganic scale in the stress chamber. The ambient condition may include at least one of pressure and temperature and may be measured by the downhole pressure and temperature gauge 9 in one or more embodiments.

The method 40 may also include separating phases of the fluid sample by gravity segregation or any suitable mechanical method within the stress chamber. In one or more embodiments, this step may be dependent of the type of inorganic scale sensor being used. Phase separation sensors such as a water sensor and an oil sensor (not shown) may be used to indicate when phase separation has occurred. When phase separation is included in the method 40, the location of the inorganic scale sensor 25 within the stress chamber for proper function of the sensor 25 may be determined by analysis or by laboratory testing of fluid samples having inorganic scale with known properties.

The method 40 may also include identifying when the margin decreases below a set point using a supervisory system that obtains input from a downhole pressure and temperature sensor disposed in the production zone and at least one of (a) injecting chemicals into the production zone using a chemical injection system disposed at the surface and a chemical injection mandrel disposed in the production zone and (b) operating an inflow control valve disposed in the production zone. Other operations to prevent the formation of inorganic scale in the production path may include (i) closing a choke; (ii) operating a valve in the well; (iii) changing an amount of an additive supplied to the well, (iv) changing the type of additive supplied to the well; (v) closing fluid flow from a selected production zone; (vi) isolating fluid flow from a production zone; (vii) sending a message to an operator informing about the estimated occurrence of scaling precipitation using a display; and (viii) sending a suggested operation to be performed by an operator using a display. Any of the above components for preventing the formation of inorganic scale may be referred to as an inorganic scale prevention system. In general, when the ambient environmental condition at a location is equal to the ambient condition that causes inorganic scale formation in the stress chamber (i.e., the difference equals zero), inorganic scale formation may occur. However, the setpoint may be selected to accommodate sensor error and statistical deviations of measurements and processing in order to prevent in advertent operation of the inorganic scale prevention system.

The method 40 may also include: receiving an ambient condition at which inorganic scale forms is a sample of the production fluid in a stress chamber downhole that is configured to apply the ambient condition to the sample; calculating a difference between the ambient condition applied by the stress chamber and an ambient environmental condition at points along the production path; and identifying those points along the production path where the difference is less than a selected setpoint.

The above disclosed apparatus and method provide several advantages. One advantage is that prevention of inorganic scale formation in production pipes and tubing can prevent damage to production equipment, lower equipment downtime, and lower maintenance requirements. Another advantage of using the disclosed apparatus and method is that measurements at a single point near the highest pressure location in the production system (e.g., the lower completion or lower production zone) can replace multiple, discrete or distributed sensors throughout the production system. Another advantage of using these techniques that that information about fluid stability and precipitation can be obtained before deposition occurs so that preventative actions, contingency plans and remedial operations can be staged prior to the production problem occurring. Accordingly, the method 40 may include implementing these preventive actions, contingency plans and remedial operations. Since the inorganic scale sensor is detecting precipitation and not deposition, another advantage is that the stress chamber is easier to clean and maintain than sensors that are based on deposition of an inorganic scale. In addition, these techniques use live fluids in the lower completion before production fluids from multiple zones and wells are co-mingled in the production tubing. This allows for the performance of inhibitors to be evaluated in real conditions such that the trouble zones and wells can then be treated separately or shut-in to control risks.

A further advantage of the disclosed apparatus and method is that a static evaluation of formation fluid is performed for improved accuracy where a formation fluid sample is drawn into the stress chamber and isolated from formation fluid flow by isolation valves for example. This is in contrast to a dynamic evaluation that would constantly or continuously sample produced fluids.

A further advantage is that an array of optical sensors may be used to simultaneously detect precipitation of both mineral scale and organic scale (e.g., asphaltenes) in the same sample.

A further advantage is that performance of various chemicals at various dose rates may be evaluated by treating the produced fluids through downhole capillary injection.

Next, particular embodiments of a pressure-volume-temperature (PVT) cell for permanent or semi-permanent use downhole are discussed. The term semi-permanent relates to the PVT cell be disposed downhole for as long as PVT measurements of produced fluids are needed. The PVT cell is configured for monitoring physical properties and phase behavior of live produced fluids under actual downhole conditions. The PVT cell is generally located at the highest pressure, most easily accessible point in the production system—the lower completion—and may be used specifically to monitor the stability of produced oil and brine towards precipitation of asphaltenes and mineral scale (respectively) downstream of the cell. It can be appreciated that the downhole PVT cell shares the same advantages of the apparatus and method discussed above.

Pressure-Volume-Temperature (PVT) cells are universally used in fluid analysis laboratories to measure the physical properties and phase behavior of produced fluids. However, laboratory analysis is limited by the high cost for obtaining pressured (live) downhole samples and transporting the samples in pressure vessels to the PVT laboratory. For subsea wells, the cost for obtaining samples is so high that live samples are only obtained when well interventions are conducted for other reasons.

Instead of using live samples, petroleum engineers frequently obtain and analyze depressurized (dead) samples of produced fluids. Using Equation of State (EOS) models, engineers then calculate the physical properties of the fluids at bottom-hole pressures and temperatures and reconstitute the samples to simulate downhole conditions. Although using reconstituted fluids works well in some applications, it has limited usefulness when samples from single wells cannot be obtained, for example, when produced fluids from two or more subsea wells flow through a subsea manifold into a common flowline.

Depressurizing produced fluids causes several changes in the composition and phase behavior of the oil and brine. Upon depressurization, the density of the oil decreases and some oils begin to precipitate asphaltene molecules. Determination of the onset pressure (also known as the flocculation point) for asphaltene precipitation is one measurement that is frequently conducted in laboratory PVT cells using a near infrared (wavelength of 1550 nm) emitter and photodiode detector. Depressurization also causes carbon dioxide gas to evolve from brine, thereby increasing the pH of the brine and causing calcium carbonate scale to precipitate from supersaturated brines. In the laboratory tests, scale precipitation is frequently observed visually when the brine becomes cloudy due to the presence of scale particles.

In summary, depressurization causes precipitation of both calcium carbonate scale and asphaltene aggregates. Furthermore, both precipitates can be detected by a drop in light transmittance through the sample. Hence, PVT analysis using a downhole PVT cell for measuring light transmittance at various pressures can overcome the depressurization issues.

Figure 5:
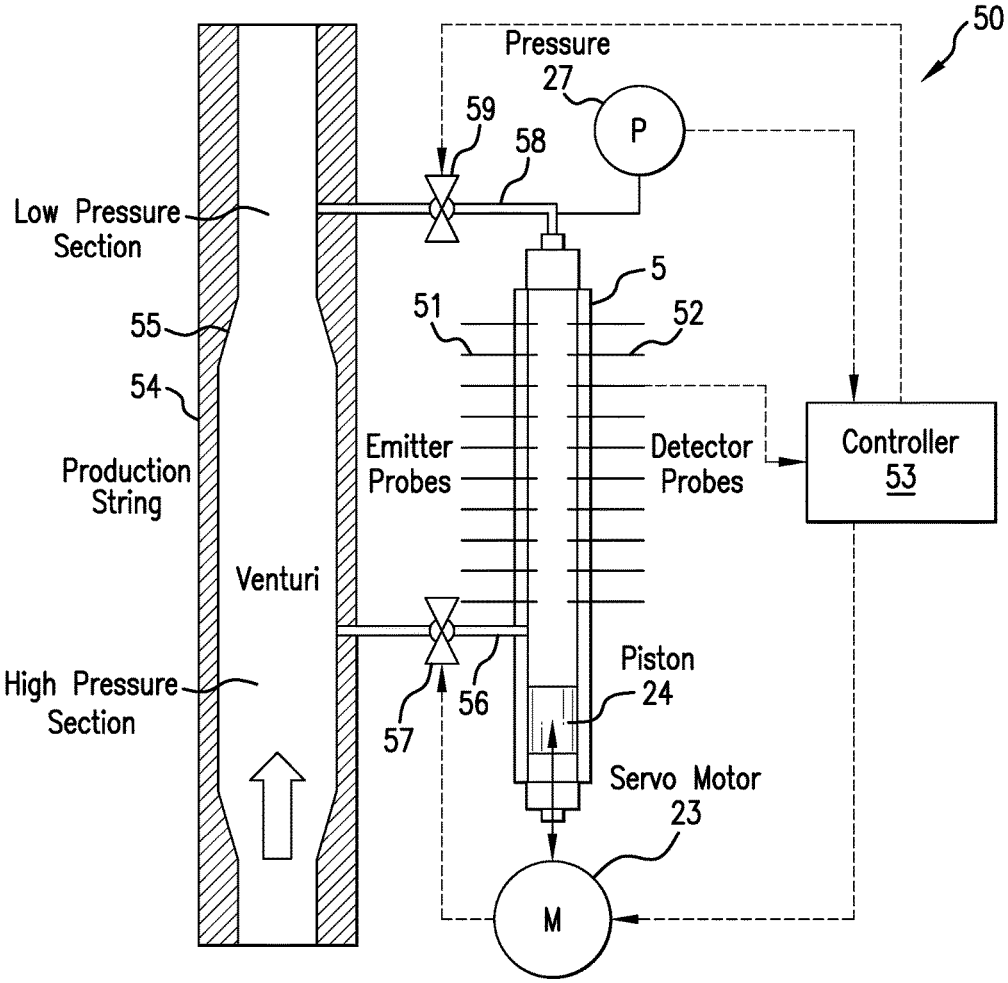
FIG. 5 depicts aspects of one embodiment of a pressure-volume-temperature (PVT) cell.

FIG. 5 illustrates one embodiment of a PVT cell 50 for permanent or semi-permanent installation downhole. The PVT cell 50 includes the stress chamber 5, the sensor 27 for sensing pressure, the piston 24, and the motor 23 to move the piston 24. The PVT cell 50 further includes an array of emitter probes 51 and a corresponding array of detector probes 52. The array of emitter probes 51 is configured to emit light into the stress chamber and thus illuminate a fluid sample disposed in the stress chamber 5. The array of detector probes 52 is configured to detect light transmitted through the fluid sample. Each detector probe 52 may include a photodetector for detecting light and producing an electrical signal corresponding to a magnitude of detected light. Each detector probe 52 is coupled to a controller 53. The controller 53 is configured to detect asphaltene and mineral scale precipitation using the electrical signals from the detector probes and provide an output signal to a user interface indicating the detection. The controller 53 may be further configured to control operations of the PVT cell 50 such as opening and closing valves, controlling movement of the piston, and recording pressure measurements sensed by the pressure sensor. The controller 53 may be calibrated for optical transmittance detection of asphaltene and mineral scale precipitation by analysis or by laboratory testing using known precipitation processes.

Still referring to FIG. 5, a sample of production fluid flowing through a production string 54 (i.e., production flow path) having a venturi 55 enters the PVT cell 50 using an inlet conduit 56 having an inlet valve 57 and an outlet conduit 58 having an outlet valve 59. With inlet and outlet valves open and the piston extended into the cell, the pressure drop in the production string caused by the venturi will divert a side-stream of the production into the cell for purposes of cleaning and filling the cell. As an alternative to filling the cell with a venturi, pumps (not shown) may be used to fill the cell.

Figure 6:
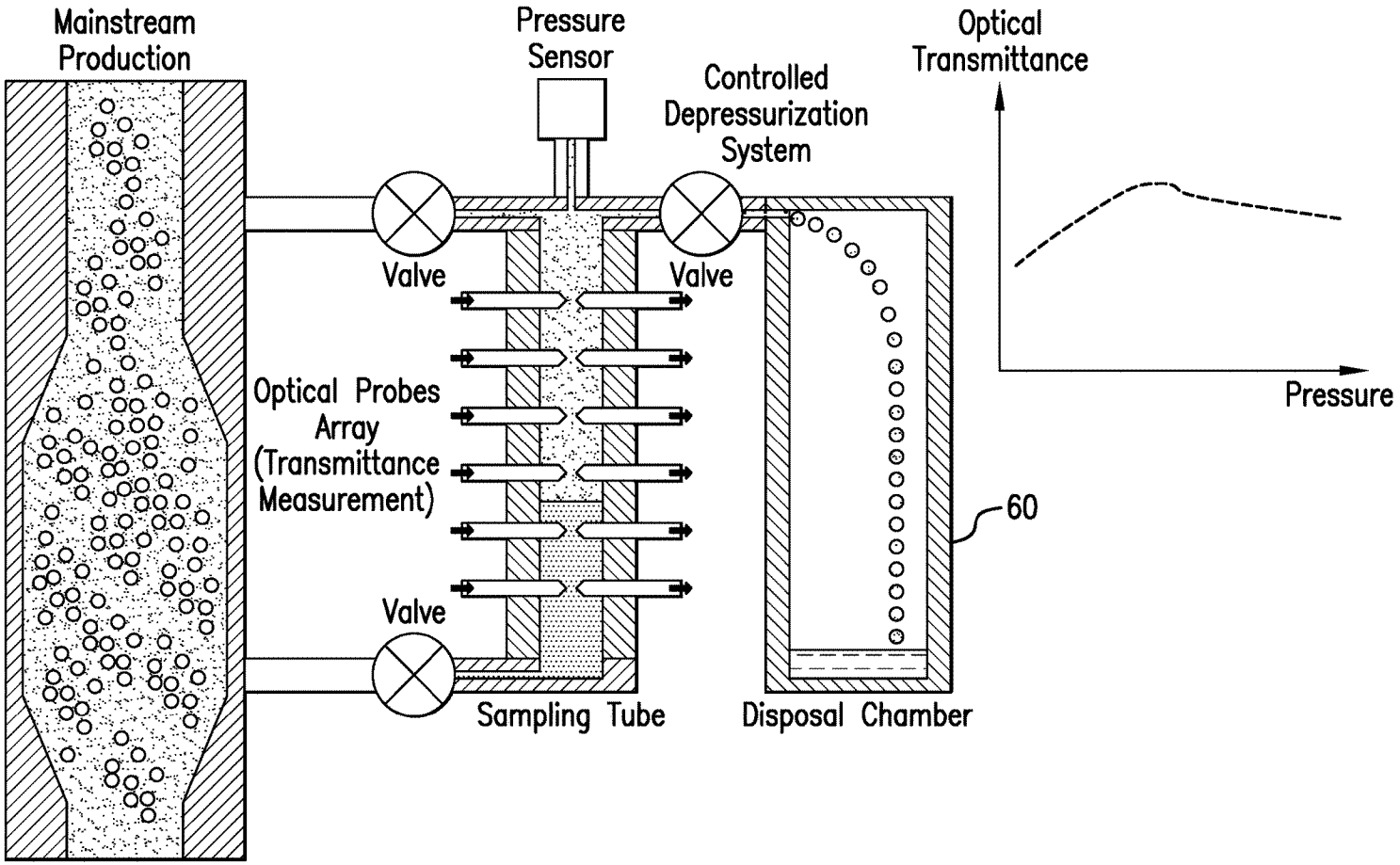
FIG. 6 depicts aspects of disposal chamber coupled to the PVT cell.

After the inlet and outlet valves are closed, density separation of the fluids is completed and equilibration is reached, the piston is retracted to drop the pressure incrementally and transmittance is measured by the array of emitter and detector probes. As an alternative to dropping the pressure by retracting a piston, the pressure in the cell can be incrementally dropped by withdrawing fluid from a bladder or by allowing the sample to drip into a vacuum chamber 60 as illustrated in FIG. 6.

Figure 7:
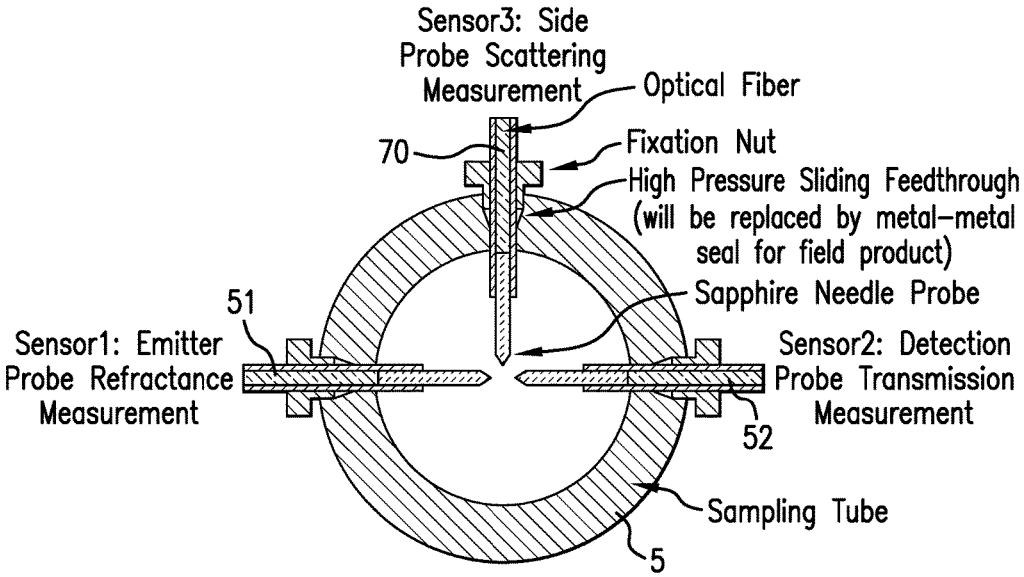
FIG. 7 depicts aspects of probe placement in one embodiment of the PVT cell.

Depending on the phase volume ratio of the fluids in the cell, some probes will be in the brine phase to detect scale precipitation while other probes will be in the oil phase to detect asphaltene precipitation. FIG. 7 depicts aspects of probe placement in one embodiment of the PVT cell 50. In the embodiment of FIG. 7, a side detection probe 70 is configured to detect light scattering in order to perform a scattering measurement. Each of the emitter and detector probes in FIG. 7 is configured to extend into the body of the cell. Alternatively, the emitter and detector probes may be outside of the body of the cell and flush mounted to a window in the cell.

Figure 8:
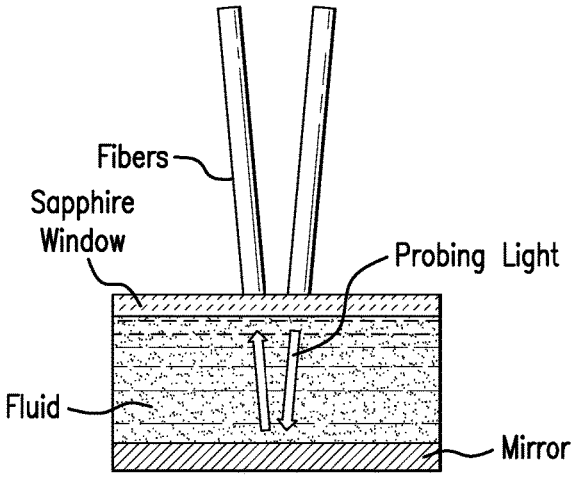
FIG. 8 depicts aspects of a configuration of the PVT cell having a variable light path length.

In some cases, fluids may be too dark to transmit sufficient light to detect the drop in transmittance caused by asphaltene or scale particles. In these cases, it would be useful to use a variable path length. In the sensor configuration illustrated in FIG. 7, the path length can be adjusted by inserting the sensors into the cell body or retracting them out of the cell body. Another variable path length configuration is illustrated in FIG. 8. Other configurations of a variable path length cell may also be used.

Operating features of the PVT cell 50 include:

1. permanently or semi-permanently installing the PVT cell in the highest pressure, most easily accessible point in the production system (e.g., in the lower completion or production zone);
2. diverting a sidestream of produced oil and brine into the PVT cell;
3. isolating the cell from the wellbore fluids by closing inlet and outlet valves to the PVT cell;
4. allowing the oil to separate from the brine by gravity separation over a period of time;
5. gradually and incrementally decreasing the pressure in the PVT cell;
6. measuring the transmittance of light through the oil and brine at each pressure;
7. determining the pressures at which asphaltenes and calcium carbonate scale begin to precipitate; and
8. correlating the precipitation pressures with the pressure in the production system to determine the point where scale and asphaltene become insoluble.

The PVT cell 50 provides users such as production engineers with the ability to:

1. anticipate and diagnose production problems caused by asphaltene and scale precipitation;
2. develop contingency plans;
3. stage remediation programs before production problems were encountered;
4. compare the efficacy of asphaltene treatment programs under actual downhole conditions;
5. compare the efficacy of scale treatment programs under actual downhole conditions; and
6. validate Equation of State (EOS) models for scale and asphaltene stability.

The PVT cell 50 has several advantages that include using the PVT cell 50 at a single point in the production system (e.g., the lower completion or lower production zone) to replace a distributed sensor network to monitor scale and asphaltene deposition. Compared to prior art methods, the PVT cell: will be lower cost than distributed sensors; will provide information about the fluid stability before deposition occurs; will enable users to determine whether precipitation occurred upstream of the PVT cell (e.g., in the perforations or skin of the wellbore) from the sign of the slope of an optical response curve; and will be easier and less costly to clean and maintain than sensors that rely on deposition instead of the precipitation in the PVT cell.

In support of the teachings herein, various analysis components may be used, including a digital and/or an analog system. For example, the supervisory system 1, the IC control module 2, the chemical injection system 6 or the controller 53 may include digital and/or analog systems. The system may have components such as a processor, storage media, memory, input, output, communications link (wired, wireless, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

The term "carrier" as used herein means any device, device component, combination of devices, media and/or member that may be used to convey, house, support or otherwise facilitate the use of another device, device component, combination of devices, media and/or member. Other exemplary non-limiting carriers include drill strings of the coiled tube type, of the jointed pipe type and any combination or portion thereof. Other carrier examples include casing pipes, wirelines, wireline sondes, slickline sondes, drop shots, bottom-hole-assemblies, drill string inserts, modules, internal housings and substrate portions thereof.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The term "couple" relates to a component being coupled to another component either directly or indirectly using an intermediate component. The term "configured" relates to a structural limitation of an apparatus that allows the apparatus to perform the task or function for which the apparatus is configured.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for estimating an ambient environment at which inorganic scale will form in a downhole fluid, the apparatus comprising:

a stress chamber disposed in a borehole in a production zone at a location that experiences a pressure within a specified range of a maximum pressure and configured to receive a sample of the fluid from the production zone, to separate an oil phase from a water phase of the sample, and to vary an ambient environment that is applied to the sample within the stress chamber, wherein the varied ambient environment includes a certain ambient environment condition that causes the formation of inorganic scale;

an inorganic scale sensor configured to sense formation of inorganic scale in the water phase within the chamber;

an ambient environment sensor configured to sense the certain ambient environment condition within the chamber at which the formation of inorganic scale occurs; and a processor configured to receive measurement data from the inorganic scale sensor and the ambient environment sensor and to identify the certain ambient environment condition at which the formation of inorganic scale occurs.

2. The apparatus according to claim 1, further comprising a controller configured to actuate an inorganic scale prevention system upon identification of the formation of inorganic scale in the stress chamber.

3. The apparatus according to claim 2, wherein the prevention system comprises an inflow control valve configured to maintain or increase a pressure of the downhole fluid.

4. The apparatus according to claim 2, wherein the prevention system comprises a chemical injection system configured to inject a chemical into the downhole fluid to prevent the formation of inorganic scale.

5. The apparatus according to claim 1, wherein the inorganic scale sensor comprises at least one of a conductivity sensor, a resonance sensor, and an optical sensor.

6. The apparatus according to claim 1, wherein the ambient environment sensor comprises at least one of a pressure sensor and a temperature sensor.

7. The apparatus according to claim 1, wherein the production zone comprises a plurality of production zones with each production zone being isolated from other adjacent production zones by at least one packer.

8. The apparatus according to claim 7, wherein an intelligent completion (IC) pack is disposed in each production zone, each IC pack comprising an electronic chemical injection mandrel, an electric inflow control valve, a downhole pressure and temperature sensor, the stress chamber, and an electric line configured to supply electric power and/or communications to components of the IC pack.

9. The apparatus according to claim 1, wherein the stress chamber comprises:

a piston configured to move within the chamber, and a motor mechanically coupled to the piston and configured to move the piston.

10. The apparatus according to claim 1, wherein the inorganic scale comprises at least one of carbonate, sulfate, sulfide, iron, silica, and salt.

11. The apparatus according to claim 1, further comprising an inlet conduit coupled to one end of the stress chamber and an outlet conduit coupled to another end of the stress chamber, the inlet conduit and the outlet conduit being coupled to a flow path of a production fluid.

12. The apparatus according to claim 11, further comprising a venturi disposed in the flow path, wherein the inlet conduit is connected to a high pressure section of the venturi and the outlet conduit is connected to a low pressure section of the venturi.

13. The apparatus according to claim 12, further comprising an inlet valve disposed in the inlet conduit and an outlet valve disposed in the outlet conduit.

14. The apparatus according to claim 11, wherein the inorganic scale sensor comprises an array of emitter probes configured to emit light into the stress chamber and an array of detector probes configured to detect light that has traversed the sample in the stress chamber.

15. The apparatus according to claim 14, wherein the emitter probes in the array of emitter probes and the detector probes in the array of detector probes are configured to be inserted into or retracted from the stress chamber.

16. The apparatus according to claim 1, wherein the location of the stress chamber is a location having maximum pressure.

17. An apparatus configured for preventing formation of inorganic scale in a fluid produced from a production zone in a plurality of production zones of a borehole penetrating the earth, the apparatus comprising:

an intelligent completion (IC) pack disposed in each production zone, each IC pack comprising an electronic chemical injection mandrel, an electric inflow control valve, a downhole pressure and temperature sensor, a stress chamber, and an electric line configured to supply electric power and/or communications to components of the IC pack, wherein the stress chamber is configured to receive a sample of the fluid from a production zone in which the stress chamber is disposed at a location that experiences a pressure within a specified range of a maximum pressure, to separate an oil phase from a water phase of the sample, and to vary an ambient environment that is applied to the sample within the stress chamber, wherein the varied ambient environment includes a certain ambient environment condition that causes the formation of inorganic scale, and the stress chamber comprises a piston configured to move within the chamber, a motor mechanically coupled to the piston and configured to move the piston, an inorganic scale sensor configured to sense formation of inorganic scale in the water phase within the chamber, and an ambient environment sensor configured to sense the certain ambient environment condition within the chamber at which the formation of inorganic scale occurs;

a chemical injection system disposed at a surface of the earth and configured to inject a chemical into a selected production zone using a chemical injection line and a selected chemical injection mandrel;

an IC control module configured to control each of the IC packs; and a supervisory system configured to obtain measurement data from each downhole sensor, determine a margin to formation of inorganic scale in each production zone using the measurement data, and send commands to the chemical injection system and the IC control module to prevent the formation of inorganic scale.

18. The apparatus according to claim 17, wherein the ambient environment condition comprises at least one of pressure and temperature.

* * * * *